US005201914A

United States Patent [19]

Hollick

[11] Patent Number: 5,201,914

[45] Date of Patent: Apr. 13, 1993

[54] ELECTRICAL CONNECTOR

[75] Inventor: David J. Hollick, Chinnor, England

[73] Assignee: B & H (Nottm) Ltd., England

[21] Appl. No.: 809,881

[22] Filed: Dec. 17, 1991

[30] Foreign Application Priority Data

Dec. 18, 1990 [GB] United Kingdom ..... 9027369
Sep. 14, 1991 [GB] United Kingdom ..... 9119694

[51] Int. Cl.[5] ..... H01R 4/30
[52] U.S. Cl. ..... 439/801; 439/810
[58] Field of Search ..... 439/801, 812, 813, 811, 439/814, 810; 179/84 S, 88 S

[56] References Cited

U.S. PATENT DOCUMENTS

| | | | |
|---|---|---|---|
| 2,399,028 | 4/1946 | Hermann | 439/811 |
| 3,125,397 | 3/1964 | McGrath | 439/811 |
| 3,836,941 | 9/1974 | Izraeli | 439/810 X |
| 4,533,205 | 8/1985 | Frank | 339/247 |
| 4,795,365 | 1/1989 | Johnston et al. | 439/411 |

FOREIGN PATENT DOCUMENTS

| | | | |
|---|---|---|---|
| 647530 | 7/1937 | Fed. Rep. of Germany | 439/811 |
| 808054 | 7/1951 | Fed. Rep. of Germany | 179/84 S |
| 923562 | 2/1955 | Fed. Rep. of Germany | 439/812 |
| 865588 | 4/1961 | United Kingdom . | |
| 1432389 | 4/1976 | United Kingdom . | |
| 1433946 | 4/1976 | United Kingdom . | |
| 1525843 | 9/1978 | United Kingdom . | |
| 2059191 | 4/1981 | United Kingdom . | |

*Primary Examiner*—Eugene F. Desmond
*Attorney, Agent, or Firm*—Marshall, O'Toole, Gerstein, Murray & Bicknell

[57] ABSTRACT

An electrical connector includes a socket adapted to receive an end of an electrical conductor (32). The socket comprises an open channel member (14) into which the end of the conductor (32) may be laid, a cover member (22) which together with the open channel member (14) surrounds the end of the conductor (32), and a sleeve member (26) fitting, in use, around the open channel member (14) and the cover member (22). The cover member (22) and the sleeve member (26) have corresponding apertures (24,28) which together constitute a threaded bore through which extends a locking screw (29) for releasably securing the end of the electrical conductor (32) to the open channel member (14).

8 Claims, 3 Drawing Sheets

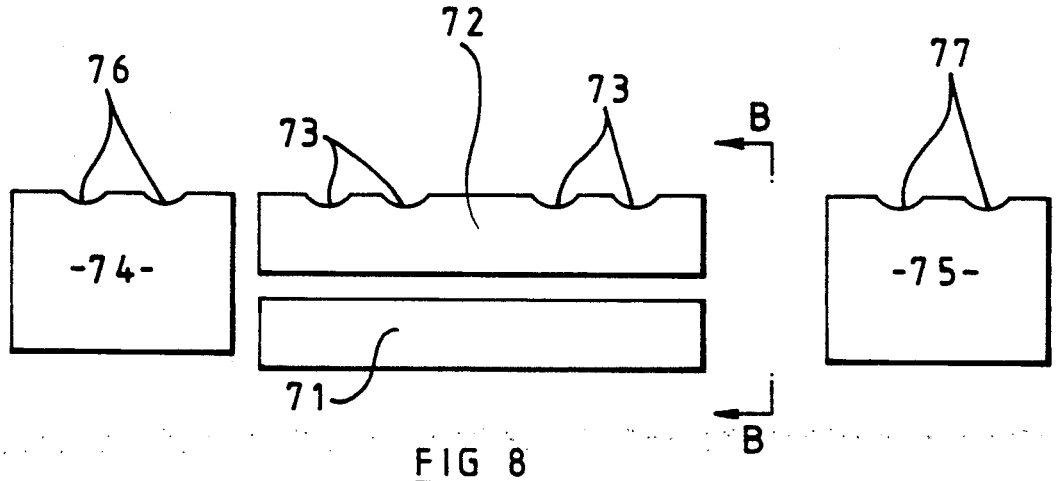
FIG 8
FIG 9
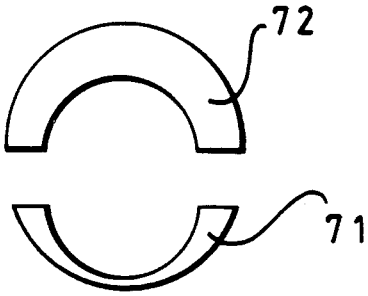
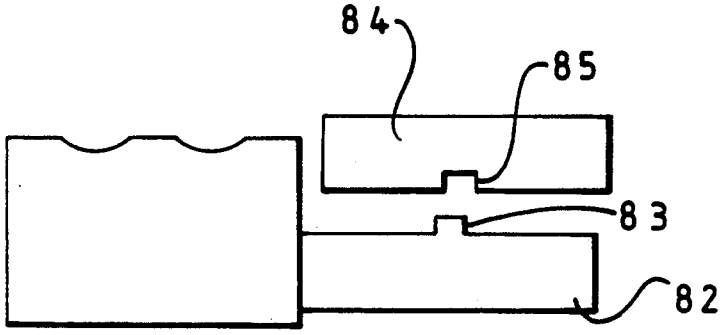
FIG 10

ELECTRICAL CONNECTOR

This invention relates to a connector for use with electrical cables.

Cable connectors are used frequently in the electrical field for electrically connecting or terminating lengths of cables. Cable connectors can be used for any size of cable, but with those that are presently available (which typically comprise a generally cylindrical body with a bore at each end into which the cable ends are inserted) it is difficult to manipulate relatively large diameter cables into position because the cables are not flexible enough.

This problem is particularly acute when, as is most commonly the case, such connectors are used when the cables are already in position. As a result, the connector must be inserted between the juxtaposed ends of the cables. Consequently, a great deal of effort is required to manoeuvre and manipulate the cables into both ends of a connector. Alternatively, a greater length of cable must be freed to enable the joint to be made than would otherwise be desired.

UK Patent Application No 2059191A discloses a terminal assembly for a cartridge fuse, comprising a cradle to receive the end of a cable and a collar fitting about the cradle. In use, the collar is fitted over the cradle before the cable end is inserted.

UK Patent No 1432389 discloses a number of electrical connectors, including one comprising a channel of generally semi-circular cross-section fitting closely within a tube formed from a spirally-wound strap. Once again, connection is made by insertion of the cable end into the open end of the tube.

This invention owes nothing to these prior disclosures and seeks to provide an improved connector.

According to the invention, there is provided an electrical connector having a socket adapted to receive an end of an electrical conductor, the socket comprising an open channel member into which the end of the conductor may be laid, a cover member which together with the open channel member surrounds the end of the conductor, and a sleeve member fitting, in use, around the open channel member and the cover member, the cover member and the sleeve member having corresponding apertures which together constitute a threaded bore through which extends a locking screw for releasably securing the end of the electrical conductor to the open channel member.

The connector according to the invention is advantageous primarily in that it facilitates the connection of cables, especially relatively inflexible cables. Also, the length of cable which must be freed to enable a joint to be made may be less than is the case with conventional connectors.

The open channel member is preferably part-cylindrical, most preferably being of generally semi-circular cross-section.

The cover member is preferably also part-cylindrical, also being most preferably of generally semi-circular cross-section, such that the open channel member and the cover member together form a tube which receives the end of the conductor.

The bores into which the cable ends are inserted (which are defined by the open channel member and the cover member) may be, for example, circular or may have the form described in our copending UK Patent Application No 9110363.0.

The connector according to the invention will be provided with a number of sockets corresponding to the number of cables to be connected. The sockets may all be of the form described, i.e. comprising an open channel member, a cover member and a sleeve member. However, for ease of use, it is generally preferred that one or more of the sockets be of generally conventional form, ie comprising a tube with one or more threaded bores through which extend locking screws. In use, the connector is connected first to one or more conductors using conventional sockets, the sockets comprising open channel member and cover member then being used for connection to further conductors.

Most commonly, the connector comprises two or three sockets.

Referring once again to the socket constructed in accordance with the present invention, the threaded bore(s) are preferably provided only in the cover member (which may be of relatively thick construction), the sleeve member serving only to hold the various components together.

The open channel member and the cover member are preferably provided with keying engagement means, e.g. in the form of corresponding projections and recesses. This prevents slippage of these components along the axis of the socket, thereby increasing the mechanical strength of the connection.

The connector according to the invention may be manufactured from any of the materials commonly used for the manufacture of conventional connectors. In general, any materials having the requisite mechanical strength and providing the necessary electrical connection may be used.

According to a second aspect of the present invention, there is provided a method of connecting an electrical conductor to a connector as claimed in claim 1, which method comprises passing the end of the conductor through the sleeve member, laying the end of the conductor in the open channel member, placing the cover member over the end of the conductor so as to surround the end of the conductor, positioning the sleeve member around the cover member and the open channel member, locating the locking screw in the threaded bore constituted by the apertures in the cover member and the sleeve member, and tightening the locking screw to as to secure the end of the conductor to the open channel member.

The invention will now be described in more detail, by way of example only, with reference to the accompanying drawings in which FIGS. 1 to 5 are perspective views of a first embodiment of a connector according to the present invention, illustrating the stages in the securement of electrical cables thereto;

FIG. 8 is a disassembled side view of a third embodiment of a connector according to the invention;

FIG. 9 is a view along the line B—B in FIG. 8; and

FIG. 10 is a partial side view of a modified version of the connector of FIG. 1.

Figure 1:
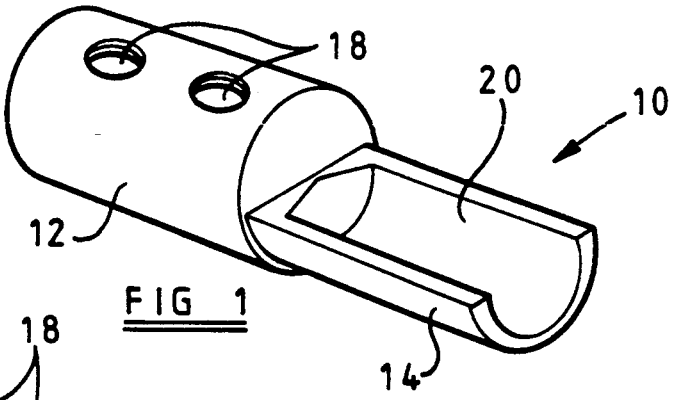
Figure 2:
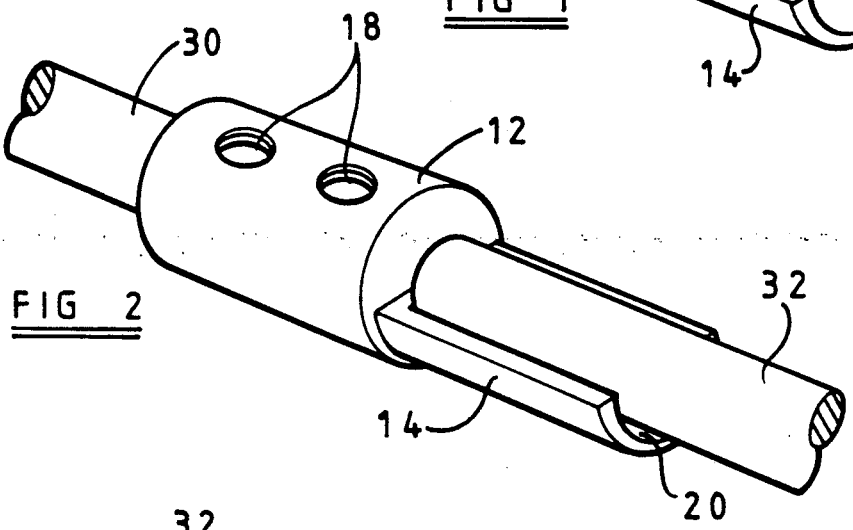
Figure 3:
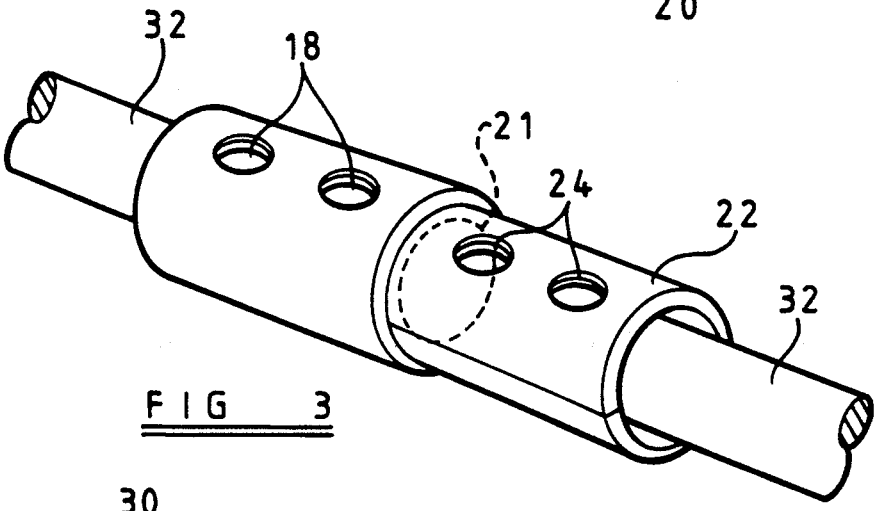
Figure 4:
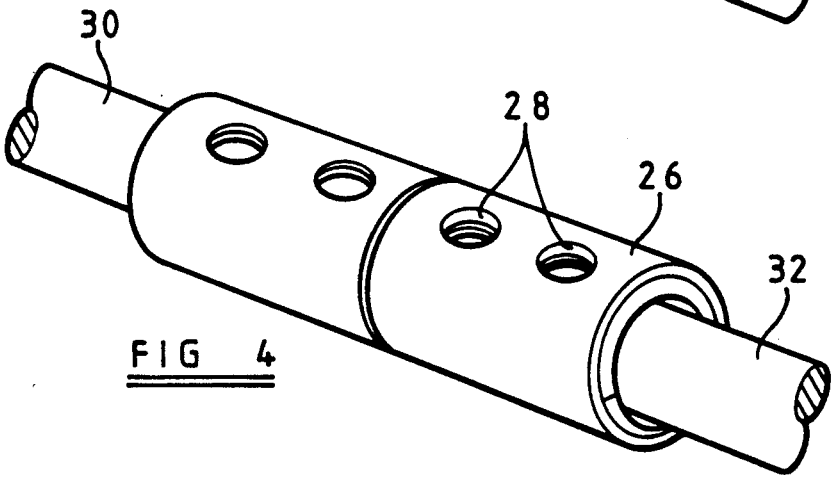

Referring first to FIGS. 1 to 5, a connector body (designated generally by the numeral 10) comprises a socket portion 12 and an open channel member 14. The socket portion 12 is of tubular configuration, having a blind bore which in use receives an end of a cable 30, and includes two screw-threaded apertures 18 into which bolts 19 (see FIG. 5) are screwed to clamp the cable end in position. The open channel 14 is of part-cylindrical configuration, and includes a channel 20 which in use receives an end of another cable 32. The member 14 co-operates with a part-cylindrical cover member 22 which is placed thereon to close the channel 20, and thus form a second blind bore 21. The cover member 22 is provided with two screw-threaded apertures 24 axially aligned with the apertures 18 of member 12.

The cover member 22 is retained in position by means of a tubular sleeve 26 which surrounds the part-cylindrical member 14 and the cover member 22. This sleeve 26 is provided with two plain apertures 28, through which screw-threaded bolts 29 (see FIG. 5) are passed for threaded engagement with the apertures 24 in the cover member 22.

In use, the connector 10 is used to join together the cables 30 and 32 after these have been installed in position. Typically, these cables are 11 kV power distribution cables and are relatively inflexible. Firstly, the end of cable 30 is inserted into the blind bore in the tubular socket portion 12. The sleeve 26 is then passed over the end of the cable 32, and the connector 10 is manoeuvred to bring the cable 32 into the channel 20 in the open channel member 14 (see FIG. 2). The cover member 22 is then placed over the open channel member 14 so that these two parts together surround the end of cable 32, following which the sleeve 26 is slid from the cable 32 onto the connector 10 to surround both the open channel member 14 and the cover member 22.

The plain apertures 28 in the sleeve 26 are then aligned with the screw-threaded apertures 24, and the bolts 19 and 20 then screwed into their respective apertures 18 and 24 to retain the cable ends in position, and also thereby effect a secure electrical connection between the cables. Alternatively, the bolts 19 can be used to secure the end of cable 30 as soon as this is inserted into the support member 12. The bolts 19 and/or 29 can be normal bolts, or can be shear head bolts whose heads shear off as soon as the bolts have been screwed into proper engagement with the cables.

Figure 6:
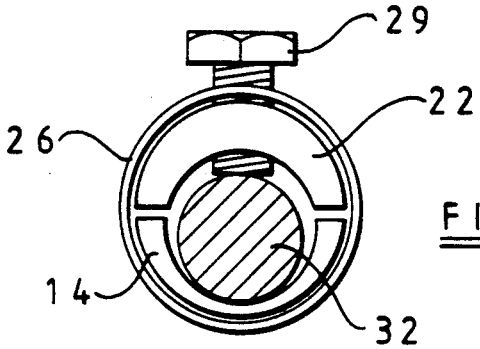
FIG. 6 is an end view of the connector of FIGS. 1 to 5, fully assembled.

As can be seen from FIG. 6 the blind bore 21 (and likewise the blind bore in member 12) is offset from the centre of the connector. This increases the depth of the threaded bores 24 (and 18) without increasing the amount of material in the connector, and hence its weight.

Figure 5:
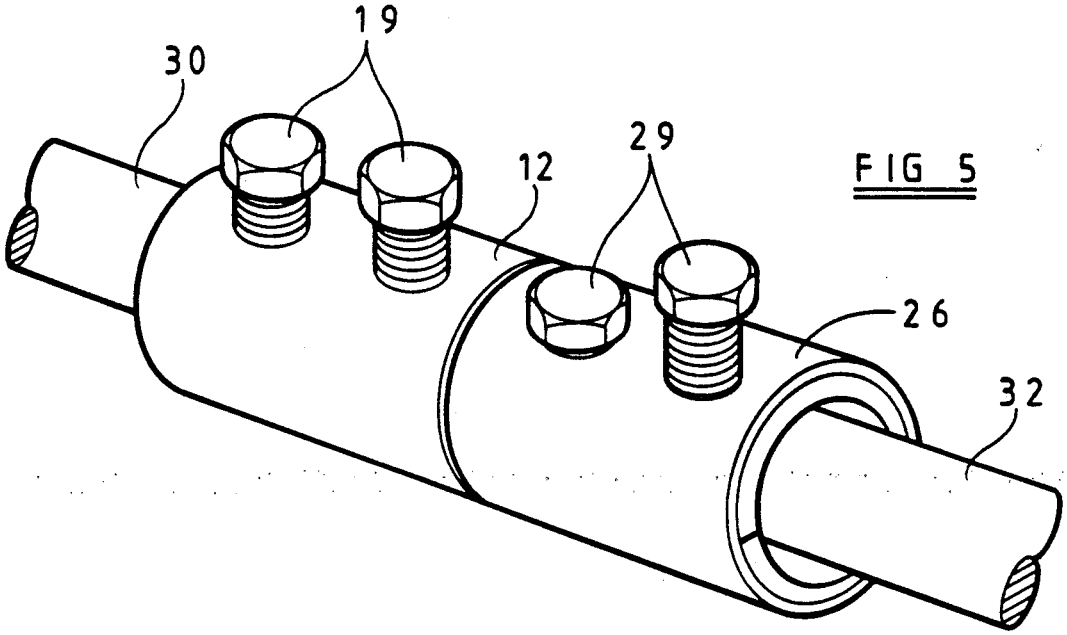
Figure 7:
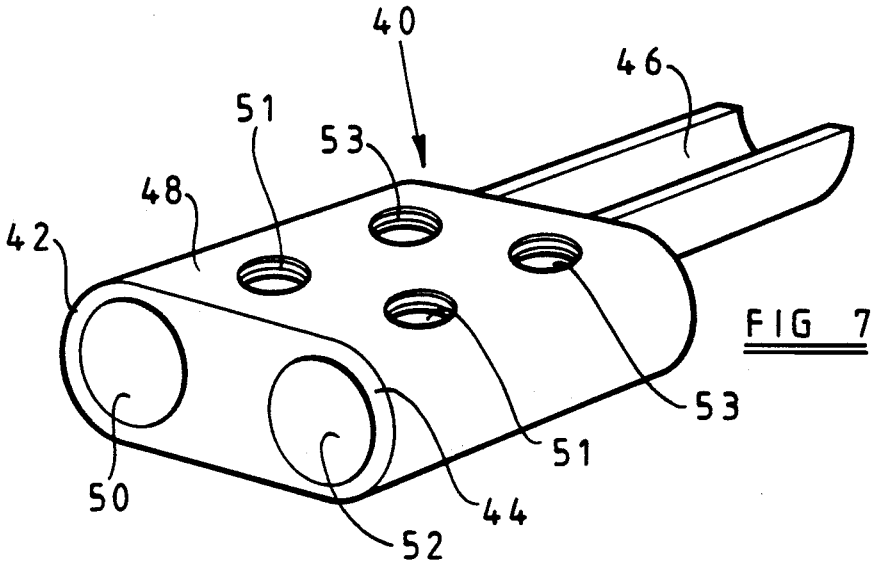
FIG. 7 is a perspective view of part of a second embodiment of a connector according to the present invention.

FIG. 7 shows part of a second connector, comprising a connector body 40, having two socket portions 42 and 44, and an open channel member 46. The socket portions 42 and 44 are formed as a single unit 48 and have respective blind bores 50 and 52 parallel to one another extending into the unit from one end of the connector body 40. Each of the bores 50 and 52 is provided with two screw-threaded apertures 51 and 53 into which bolts identical to those shown in FIG. 5 are screwed to clamp a respective cable end in position. The open channel member 46 extends from a point generally midway between the ends of the bores 50 and 52. The open channel member 46 is of part-cylindrical configuration and co-operates with a cover member and a sleeve (not shown) in exactly the same manner as the open channel member 14 of the embodiment of FIGS. 1 to 5 to retain a further cable end in position.

The embodiment shown in FIGS. 8 and 9 comprises a single part-cylindrical open channel member 71 and a part-cylindrical cover member 72, which together form a cylindrical connector with a circular through bore. The wall thickness of the cover member 72 is greater than that of the support member 71, such that the bore is offset from the centre of the cylinder.

The cover member 72 is provided with four threaded apertures 73 which receive threaded bolts as in the embodiment previously described. A pair of sleeves 74, 75 are used to hold the assembly together, each sleeve having a pair of plain apertures 76, 77 corresponding to the threaded apertures 73.

In use, the sleeves 74, 75 are slipped over the ends of two cables to be joined. The support member 71 is then placed beneath the cable ends such that the cables meet near the middle of the member 71. The cover member 72 is placed over the cable ends and the sleeves 74, 75 passed over the cylindrical assembly. After alignment of the plain apertures 76, 77 with the threaded apertures 73, the bolts (not shown) are screwed into the threaded apertures 73.

In an alternative construction, the sleeves 74, 75 are replaced by a single sleeve of full length and having four plain apertures. The sleeve is slipped over the end of one of the cables to be joined prior to assembly of the connector.

FIG. 10 shows a modified version of the connector of FIG. 1, in which the open channel member 82 is provided with upwardly-extending projections 83 and the cover member 84 with corresponding recesses 85 into which the projections 83 fit. It is equally possible, of course, for the projections to be provided on the cover member and the recesses in the sides of the open channel member.

I claim:

1. An electrical connector for end-to-end connection of electrical conductors, said connector having a plurality of sockets, each of said sockets being adapted to receive an end of an electrical conductor, at least one of said sockets comprising an open channel member into which the end of the conductor may be laid laterally, a cover member which, in use, when placed over said open channel member, together with said open channel member surrounds the end of the conductor, a sleeve member fitting, in use, around said open channel member and said cover member, said cover member and said sleeve member having corresponding apertures which together constitute a threaded bore, and a locking screw extending through said threaded bore to engage the conductor, thereby releasably securing the end of the conductor to said open channel member.

2. A connector as claimed in claim 1, wherein said open channel member is part-cylindrical.

3. A connector as claimed in claim 2, wherein said open channel member is of generally semi-circular cross-section.

4. A connector as claimed in claim 1, wherein said cover member is part-cylindrical.

5. A connector as claimed in claim 4, wherein said cover member is of generally semi-circular cross-section.

6. A connector as claimed in claim 1, further comprising one or more sockets of generally conventional form, comprising a tube with one or more threaded bores and locking screws extending through said threaded bores.

7. A connector as claimed in claim 1, wherein the threaded bore is provided only in said cover member, said sleeve member serving only to hold the various components together.

8. A connector as claimed in claim 1, wherein said open channel member and said cover member are provided with keying engagement means.

* * * * *